US007530794B2

(12) United States Patent
Sassanelli et al.

(10) Patent No.: US 7,530,794 B2
(45) Date of Patent: May 12, 2009

(54) ROTOR BLADE FOR A FIRST PHASE OF A GAS TURBINE

(75) Inventors: Giuseppe Sassanelli, Sesto Fiorentino (IT); Marco Boncinelli, Scandicci (IT)

(73) Assignee: Nuovo Pignone S.p.A., Florence (IT)

( * ) Notice: Subject to any disclaimer, the term of this patent is extended or adjusted under 35 U.S.C. 154(b) by 344 days.

(21) Appl. No.: 11/226,264

(22) Filed: Sep. 15, 2005

(65) Prior Publication Data

US 2006/0059890 A1 Mar. 23, 2006

(30) Foreign Application Priority Data

Sep. 21, 2004 (IT) ..... MI2004A1804

(51) Int. Cl.
*F01D 5/14* (2006.01)

(52) U.S. Cl. ..... 416/243; 416/241 R; 416/DIG. 2

(58) Field of Classification Search ..... 415/191, 415/208.1, 208.2, 209.4, 210.1, 211.2; 416/223 R, 416/223 A, 241 R, 243, DIG. 2, DIG. 5
See application file for complete search history.

(56) References Cited

U.S. PATENT DOCUMENTS 5,393,198 A * 2/1995 Noda et al. ..... 415/115
5,641,268 A * 6/1997 Martin et al. ..... 415/191
5,980,209 A * 11/1999 Barry et al. ..... 416/223 A
6,398,489 B1 6/2002 Burdgick et al.
6,450,770 B1 9/2002 Wang et al.
6,461,109 B1 10/2002 Wedlake et al.
6,461,110 B1 10/2002 By et al.
6,474,948 B1 11/2002 Pirolla et al.
6,503,054 B1 1/2003 Bielek et al.
6,503,059 B1 1/2003 Frost et al.
6,558,122 B1 5/2003 Xu et al.
6,685,434 B1 2/2004 Humanchuk et al.
6,715,990 B1 4/2004 Arness et al.
6,722,852 B1 4/2004 Wedlake et al.
6,722,853 B1 4/2004 Humanchuk et al.

(Continued)

OTHER PUBLICATIONS

U.S. Appl. No. 10/900,200, filed Jul. 28, 2004, entitled: Airfoil Shape and Sidewall Flowpath Surfaces for a Turbine Nozzle.

(Continued)

*Primary Examiner*—Christopher Verdier
(74) *Attorney, Agent, or Firm*—Nixon & Vanderhye, P.C.

(57) ABSTRACT

Blade (1) of a rotor for a first phase of a gas turbine having a profile identified by means of a series of closed intersection curves (20) between the profile itself and planes (X,Y) lying at distances (Z) from the central axis, each closed curve (20) has a first rounded end (21) and a second rounded end (22), which connect the trace of the first surface (3) with the trace of the second surface (5) in depression, the first end (21) first meets a gas flow of the turbine, each closed curve (20) has an axial chord (40) defined as the maximum distance of the first end (21) from the second end (22) along the axis (X), each closed curve (20) has a thickness (30) of the first end (21) defined as the maximum diameter of the circle inscribed in the first end (21); said dimensionless thickness (30), i.e. divided by the axial chord (40), has a quadric distribution according to a curve of the fourth order along the axis (Z).

5 Claims, 6 Drawing Sheets

U.S. PATENT DOCUMENTS 6,739,838 B1 5/2004 Bielek et al.
6,769,878 B1 * 8/2004 Parker et al. ..... 416/243
6,769,879 B1 8/2004 Cleveland et al.
6,779,977 B2 8/2004 Lagrange et al.
6,779,980 B1 8/2004 Brittingham et al.
6,808,368 B1 10/2004 Tomberg et al.
6,832,897 B2 12/2004 Urban
6,854,961 B2 2/2005 Zhang et al.
6,857,855 B1 2/2005 Snook et al.
6,866,477 B2 3/2005 Arness et al.
6,881,038 B1 4/2005 Beddard et al.
6,884,038 B2 4/2005 Hyde et al.
6,910,868 B2 6/2005 Hyde et al.

OTHER PUBLICATIONS

U.S. Appl. No. 10/853,240, filed May 26, 2004, entitled: Internal Core Profile for a Turbine Nozzle Airfoil.
U.S. Appl. No. 10/986,162, filed Nov. 12, 2004, entitled: Airfoil Shape for a Compressor Blade.
U.S. Appl. No. 11/090,300, filed Mar. 28, 2005, entitled: First and Second Stage Turbine Airfoil Shapes.

* cited by examiner

ROTOR BLADE FOR A FIRST PHASE OF A GAS TURBINE

BACKGROUND

The present invention relates to a rotor blade for a first phase of a gas turbine.

Gas turbine refers to a rotating thermal machine which converts the enthalpy of a gas into useful energy, using gases coming from a combustion, and which supplies mechanical power on a rotating shaft.

The turbine therefore normally comprises a compressor or turbo-compressor, inside which the air taken from the outside environment is brought under pressure.

Various injectors feed the fuel which is mixed with the air to form an air-fuel ignition mixture.

The axial compressor is entrained by a turbine, in the true sense, i.e. a turbo-expander, which supplies mechanical energy to a user transforming the enthalpy of the gases combusted in the combustion chamber.

In applications for the generation of mechanical energy, the expansion jump is subdivided into two partial jumps, each of which takes place inside a turbine. The high-pressure turbine, downstream of the combustion chamber, entrains the compressor. The low-pressure turbine, which collects the gases coming from the high-pressure turbine, is then connected to a user.

The turbo-expander, turbo-compressor, combustion chamber (or heater), outlet shaft, regulation system and ignition system, form the essential parts of a gas turbine plant.

As far as the functioning of a gas turbine is concerned, it is known that the fluid penetrates the compressor through a series of inlet ducts.

In these canalizations, the gas has low-pressure and low-temperature characteristics, whereas, as it passes through the compressor, the gas is compressed and its temperature increases.

It then penetrates into the combustion (or heating) chamber, where it undergoes a further significant increase in temperature.

The heat necessary for the temperature increase of the gas is supplied by the combustion of liquid fuel introduced into the heating chamber, by means of injectors.

The triggering of the combustion, when the machine is activated, is obtained by means of sparking plugs.

At the outlet of the combustion chamber, the high-pressure and high-temperature gas reaches the turbine, through specific ducts, where it gives up part of the energy accumulated in the compressor and heating chamber (combustor) and then flows outside by means of the discharge channels.

As the energy conferred by the gas to the turbine is greater than that absorbed thereby in the compressor, a certain quantity of energy remains available, on the shaft of the machine, which purified of the work absorbed by the accessories and passive resistances of the moving mechanical organs, forms the useful work of the plant.

As a result of the high specific energy made available, the turbines in the true sense, i.e. the turbo-expanders, are generally multi-phase to optimize the yield of the energy transformation transferred by the gas into useful work.

The phase is therefore the constitutive element for each section of a turbine and comprises a stator and a rotor, each equipped with a series of blades.

One of the main requisites common to all turbines, however, is linked to the high efficiency which must be obtained for operating on all the components of the turbine.

In recent years, technologically avant-garde turbines have been further improved, by raising the thermodynamic cycle parameters such as combustion temperature, pressure changes, efficacy of the cooling system and components of the turbine.

Nowadays, for a further improvement in efficiency, it is necessary to operate on the aerodynamic parameters of the profiles of the blade system.

The geometrical configuration of the blade system significantly influences the aerodynamic efficiency.

This depends on the fact that the geometrical characteristics of the blade determine the distribution of the relative fluid rates, consequently influencing the distribution of the limit layers along the walls and, last but not least, friction losses.

In a low-pressure turbine, it is observed that the rotation rate operating conditions can vary from 50% to 105% of the nominal rate and consequently, the blade system of the turbines must maintain a high aerodynamic efficiency within a very wide range.

Particularly in the case of rotor blades of a first phase of a low-pressure turbine, an extremely high efficiency is required, at the same time maintaining an appropriate aerodynamic and mechanical load.

At present, it is difficult to have blades which allow a high efficiency with variations in the functioning conditions of the turbine and which, at the same time, are capable of maintaining a useful life.

An objective of the present invention is to provide a rotor blade for a first phase of a gas turbine which allows high aerodynamic performances within a wide functioning range.

A further objective is to provide a rotor blade for a first phase of a gas turbine which, at the same time, enables a high useful life of the component itself.

Another objective is to provide a rotor blade for a first phase of a gas turbine which allows high aerodynamic performances within a wide functioning range and which, at the same time, enables a useful life of the component itself.

Further characteristics of the invention are indicated in the specification and claims.

The characteristics and advantages of a rotor blade for a first phase of a gas turbine according to the present invention will appear more evident from the following, illustrative and non-limiting description, referring to the enclosed schematic drawings in which:

DETAILED DESCRIPTION OF THE DRAWINGS

Figure 1:
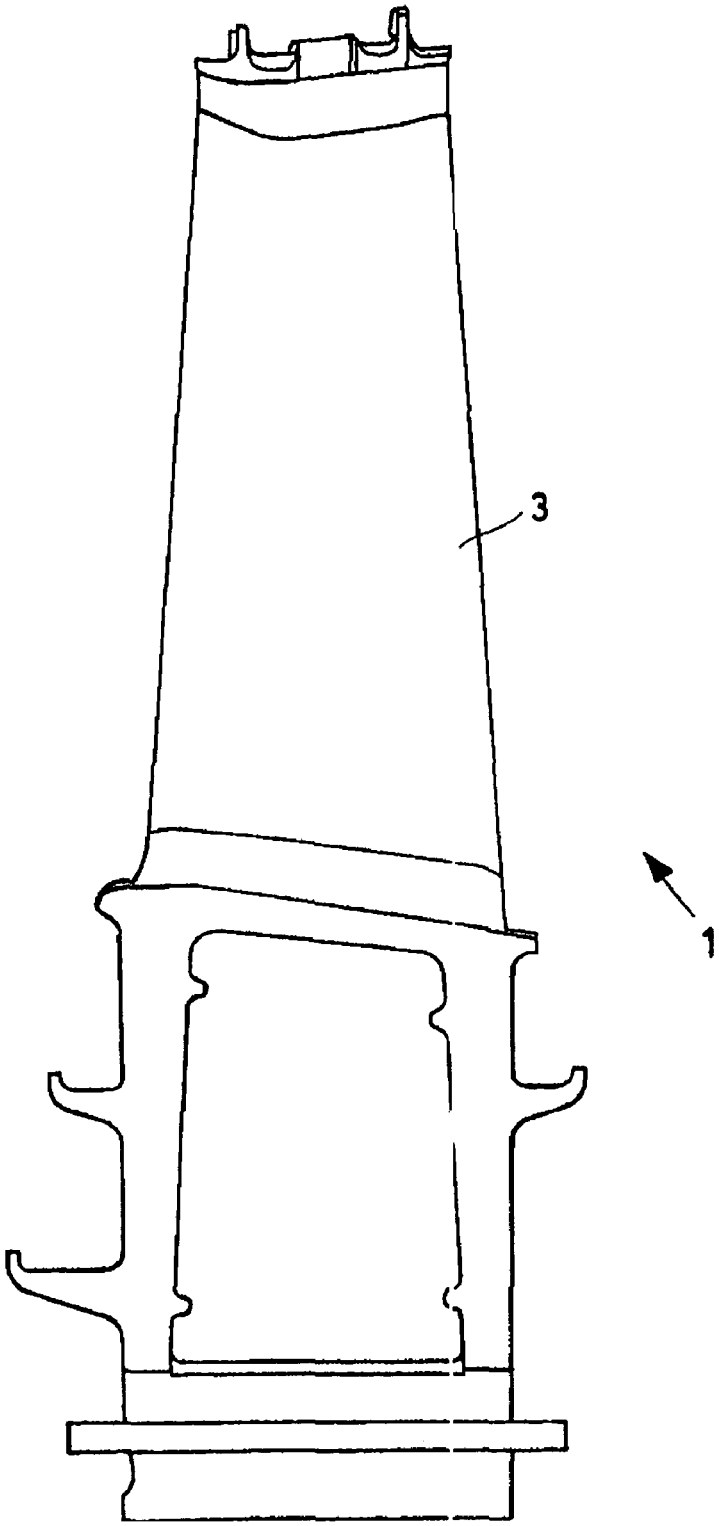
FIG. 1 is a raised view of a blade of the rotor of a turbine produced with the aerodynamic profile according to the invention.
Figure 2:
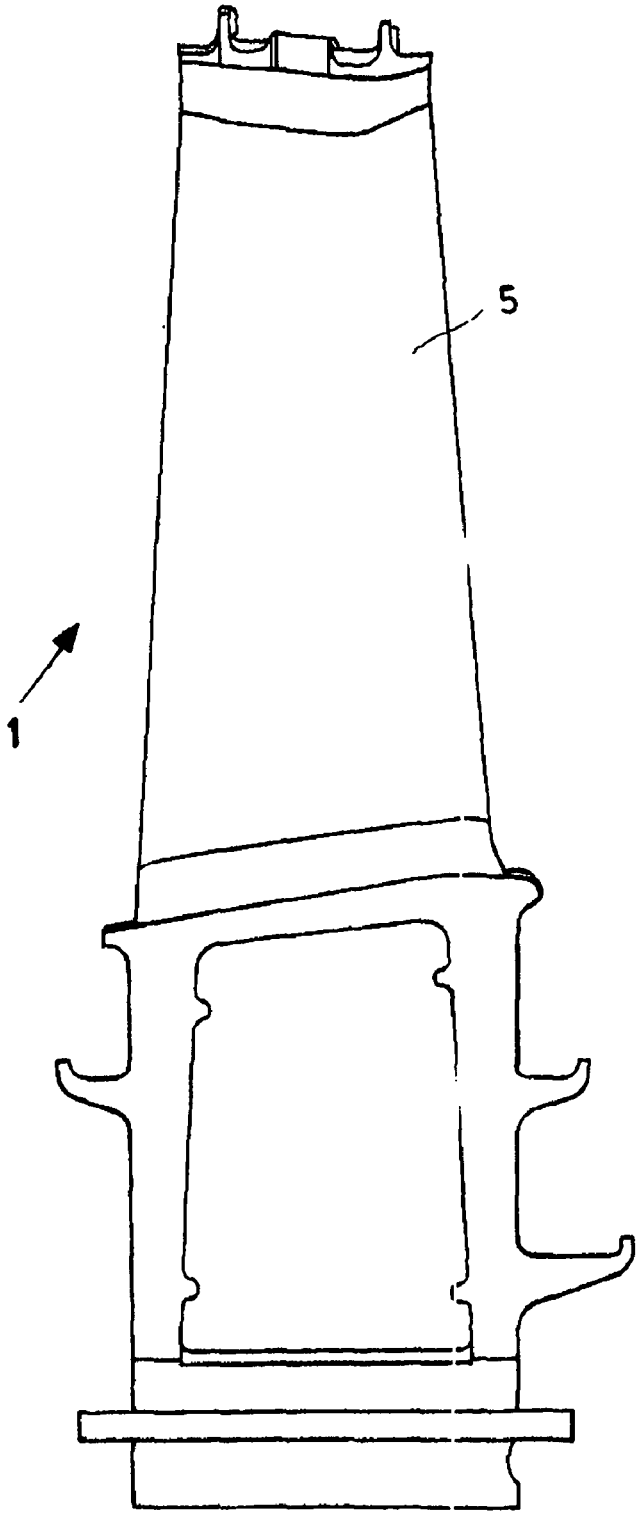
FIG. 2 is a raised view of the opposite side of the blade of FIG. 1.
Figure 3:
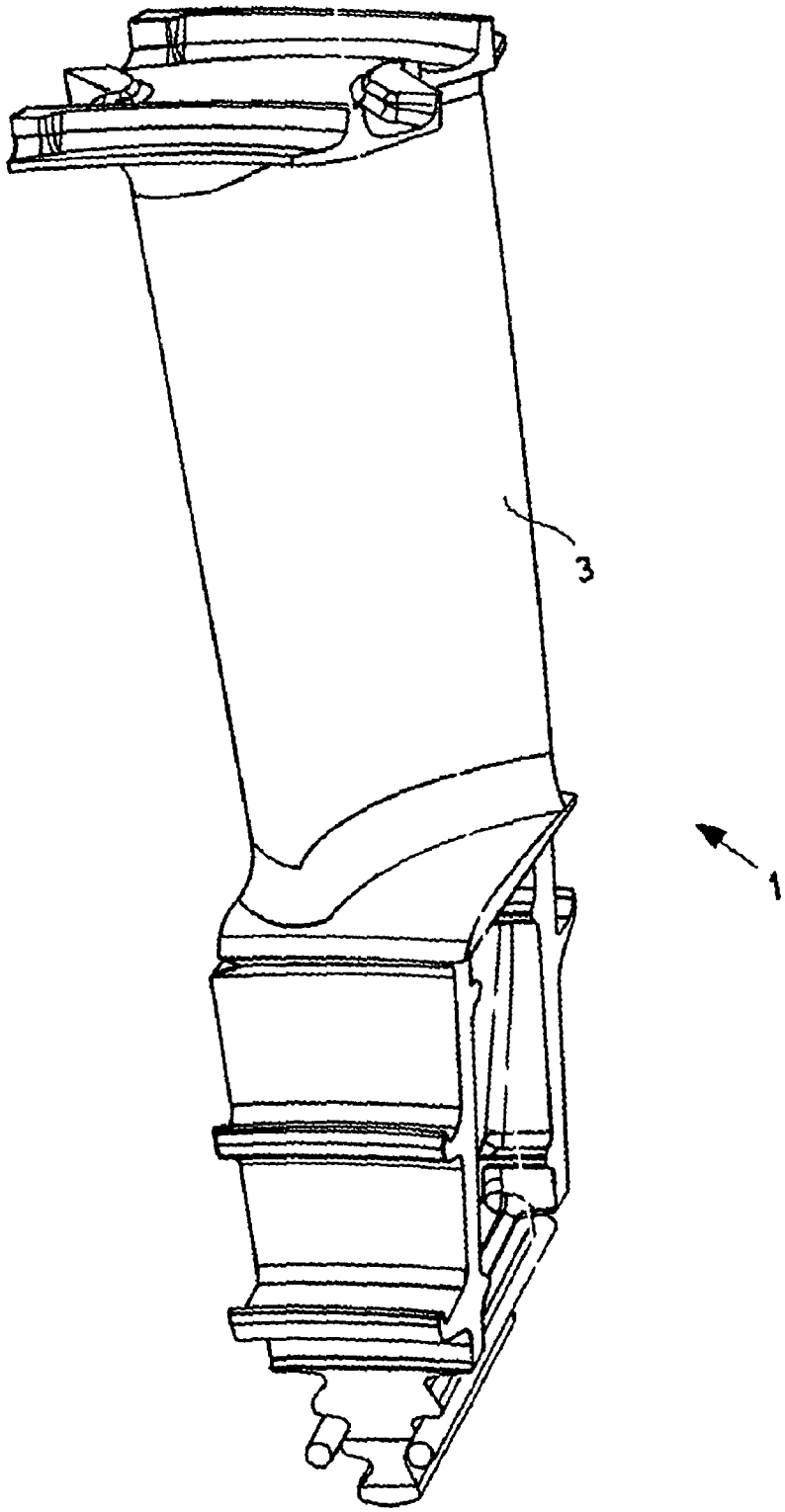
FIG. 3 is a raised perspective left side view of a blade according to the invention.
Figure 4:
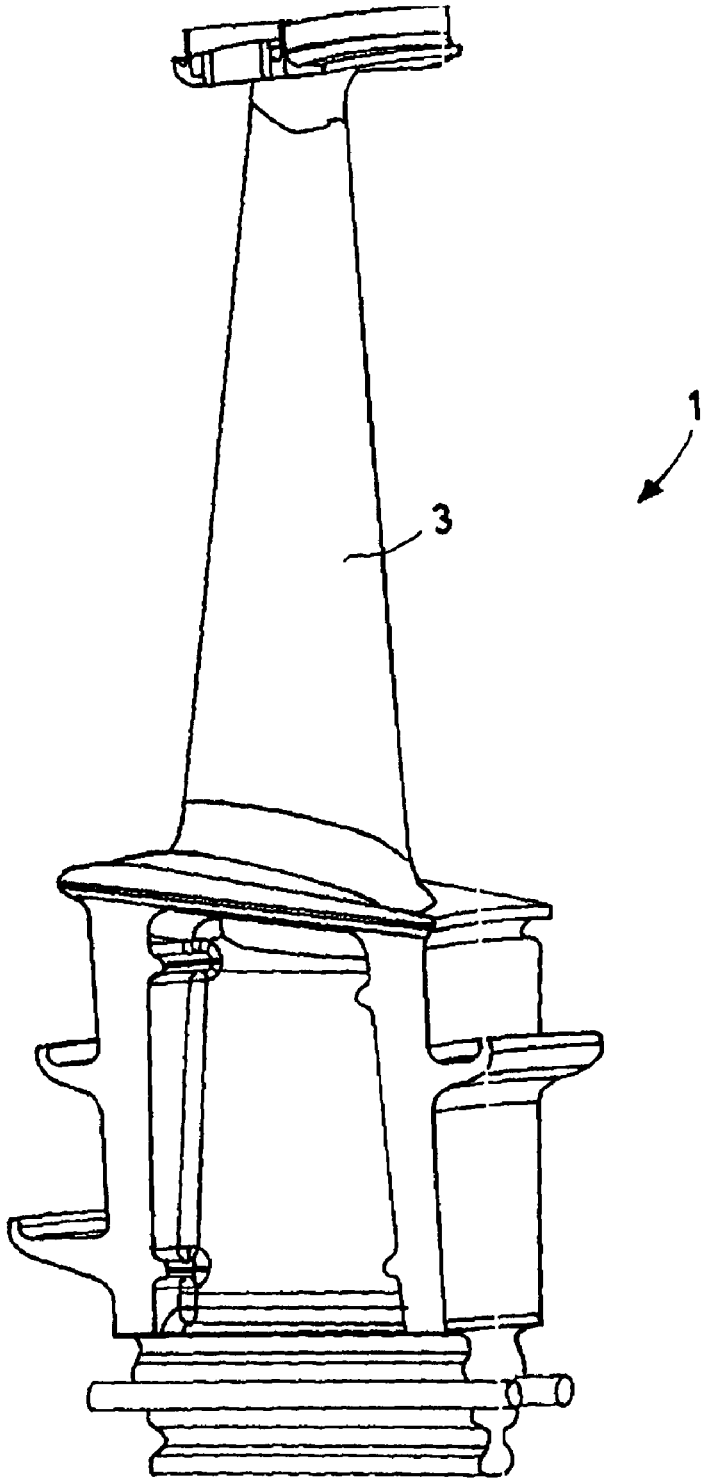
FIG. 4 is a raised perspective right side view of a blade according to the invention.
Figure 5:
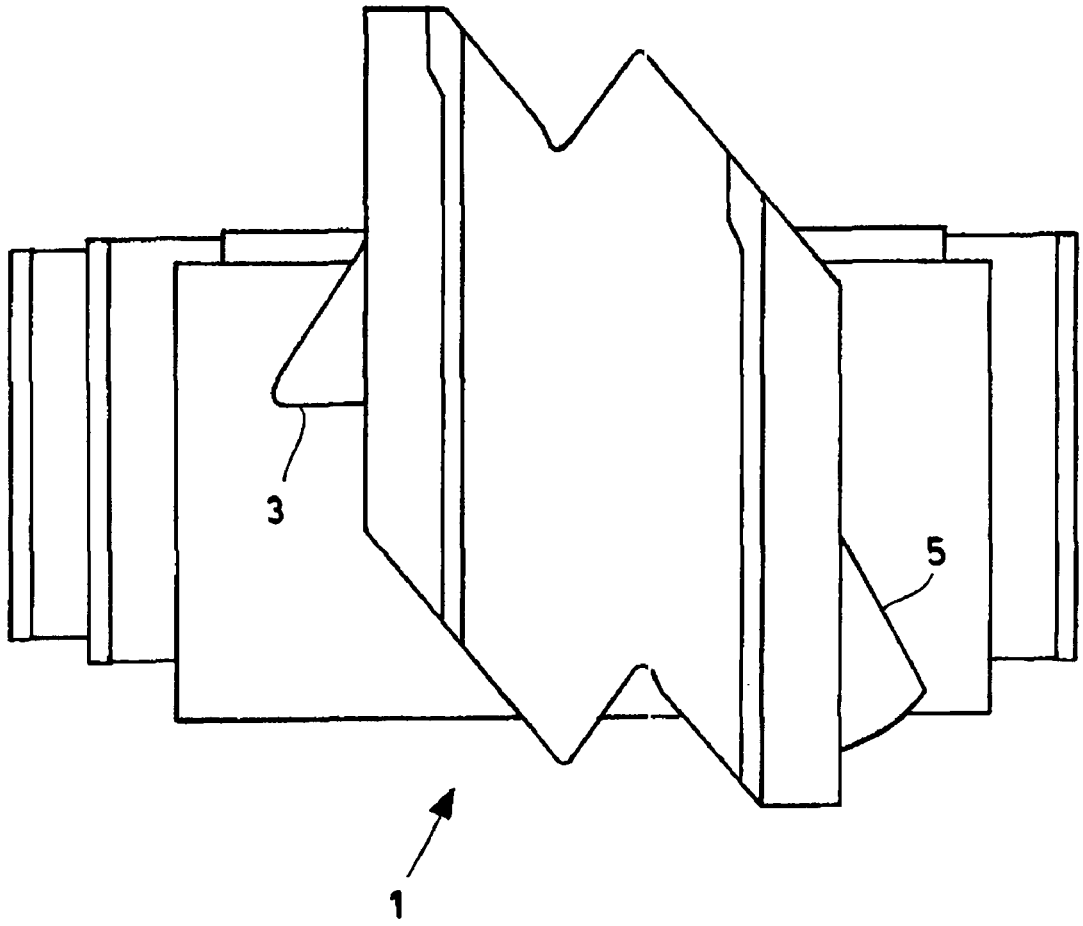
FIG. 5 is a view from above of a blade according to the invention.

With reference to the figures, these show a blade 1 of a rotor for a first phase of a gas turbine.

The blade 1 is inserted together with a series of blades onto a rotor of the gas turbine.

The blade 1 is defined by means of coordinates of a discreet combination of points, in a Cartesian reference system X,Y,Z, wherein the axis Z is a radial axis intersecting the central axis of the turbine.

The blade 1 has a profile which is defined by means of a series of closed intersection curves 20 between the profile itself and planes (X,Y) lying at distances Z from the central axis.

The profile of said blade 1 comprises a first concave surface 3, which is under pressure, and a second convex surface 5 which is in depression and which is opposite to the first.

The two surfaces 3, 5 are continuous and jointly form the profile of each blade 1.

At the ends, according to the known art, there is a connector between each blade 1 and the rotor itself.

Each closed curve 20 is substantially "C"-shaped, having a first rounded end 21 and a second rounded end 22, which connect the trace of the first surface 3 with the trace of the second surface 5 in depression.

Said first end 21 at the inlet of each closed curve is that which the gas flow first comes in contact with.

The thickness 30 of said first end 21 is defined as the maximum diameter of the circle inscribed in said first end 21.

Said thickness 30 of each closed curve 20 greatly influences the aerodynamic operating conditions of the blade 1 which are different from the project conditions.

Said thickness 30 is dimensionless with respect to the axial chord 40 defined as the maximum distance of the first end 21 from the second end 22 along the axis X.

Said dimensionless thickness 30, i.e. divided by the axial chord 40, has a distribution along the axis Z which allows a high aerodynamic efficiency to be obtained within a wide functioning range of the gas turbine.

Said dimensionless thickness 30 has a quadric distribution along the axis Z.

Starting from the base of said blade 1 along the axis Z, said quadric distribution has initially decreasing and then increasing values.

In this way, it is possible to maintain a high useful life of the blade 1 and also have a high aerodynamic efficiency which is constant, or only slightly varying, within a wide functioning range of the gas turbine.

This advantageously proves to be extremely useful when a variable nozzle is used, which greatly varies the fluid-dynamic conditions of the gas flow at the inlet of the first phase rotor.

According to a further aspect of the present invention, a rotor is provided for a first phase of a gas turbine equipped with a variable suction nozzle, said rotor comprising a series of shaped blades 1, each of which having a shaped aerodynamic profile.

The aerodynamic profile of each blade 1 is defined by means of a series of closed curves 20 whose coordinates are defined with respect to a Cartesian reference system X,Y,Z, wherein the axis Z is a radial axis intersecting the central axis of the turbine, and said closed curves 20 lying at distances Z from the central axis, are defined according to Table I, whose values of each closed curve 20 refer to a room temperature profile and are divided by value, expressed in millimetres, of the axial chord 40 along the axis X, indicated in Table I with CHX.

TABLE I

| X/CHX | Y/CHX | Z/CHX |
|---|---|---|
| −0.480297 | −0.026870 | 6.484508 |
| −0.481925 | −0.025509 | 6.484508 |
| −0.483739 | −0.023341 | 6.484508 |
| −0.485465 | −0.020259 | 6.484508 |
| −0.486864 | −0.016262 | 6.484508 |
| −0.487805 | −0.010702 | 6.484508 |
| −0.487691 | −0.003349 | 6.484508 |
| −0.486035 | 0.005680 | 6.484508 |
| −0.482433 | 0.016237 | 6.484508 |
| −0.476566 | 0.028148 | 6.484508 |
| −0.468143 | 0.041218 | 6.484508 |
| −0.456753 | 0.055643 | 6.484508 |
| −0.442359 | 0.071223 | 6.484508 |
| −0.424967 | 0.087822 | 6.484508 |
| −0.404572 | 0.105318 | 6.484508 |
| −0.381096 | 0.123506 | 6.484508 |
| −0.354239 | 0.141859 | 6.484508 |
| −0.324979 | 0.159064 | 6.484508 |
| −0.293230 | 0.174621 | 6.484508 |
| −0.258989 | 0.187995 | 6.484508 |
| −0.222335 | 0.198628 | 6.484508 |
| −0.183420 | 0.205913 | 6.484508 |
| −0.142548 | 0.209226 | 6.484508 |
| −0.100155 | 0.208004 | 6.484508 |
| −0.058172 | 0.202100 | 6.484508 |
| −0.017062 | 0.191690 | 6.484508 |
| 0.022772 | 0.177126 | 6.484508 |
| 0.061059 | 0.158832 | 6.484508 |
| 0.097635 | 0.137364 | 6.484508 |
| 0.132445 | 0.113106 | 6.484508 |
| 0.165577 | 0.086618 | 6.484508 |
| 0.197115 | 0.058253 | 6.484508 |
| 0.227185 | 0.028309 | 6.484508 |
| 0.255922 | −0.002911 | 6.484508 |
| 0.283412 | −0.035226 | 6.484508 |
| 0.308877 | −0.067385 | 6.484508 |
| 0.332517 | −0.099154 | 6.484508 |
| 0.354471 | −0.130403 | 6.484508 |
| 0.374897 | −0.160982 | 6.484508 |
| 0.393905 | −0.190799 | 6.484508 |
| 0.411614 | −0.219759 | 6.484508 |
| 0.428107 | −0.247799 | 6.484508 |
| 0.442792 | −0.273617 | 6.484508 |
| 0.455781 | −0.297147 | 6.484508 |
| 0.467180 | −0.318318 | 6.484508 |
| 0.477061 | −0.337091 | 6.484508 |
| 0.485495 | −0.353423 | 6.484508 |
| 0.492538 | −0.367284 | 6.484508 |
| 0.498488 | −0.379162 | 6.484508 |
| 0.503440 | −0.389169 | 6.484508 |
| 0.507480 | −0.397419 | 6.484508 |
| 0.510690 | −0.404029 | 6.484508 |
| 0.512195 | −0.409449 | 6.484508 |
| 0.511663 | −0.413694 | 6.484508 |
| 0.510230 | −0.416796 | 6.484508 |
| 0.508456 | −0.418925 | 6.484508 |
| 0.506757 | −0.420322 | 6.484508 |
| −0.478880 | −0.027746 | 6.484508 |
| −0.476846 | −0.028634 | 6.484508 |
| −0.474179 | −0.029391 | 6.484508 |
| −0.470902 | −0.029972 | 6.484508 |
| −0.466486 | −0.030437 | 6.484508 |
| −0.460721 | −0.030756 | 6.484508 |
| −0.453505 | −0.030941 | 6.484508 |
| −0.444735 | −0.030855 | 6.484508 |
| −0.434301 | −0.030539 | 6.484508 |
| −0.422092 | −0.030143 | 6.484508 |
| −0.407664 | −0.029671 | 6.484508 |
| −0.391013 | −0.029224 | 6.484508 |
| −0.372137 | −0.028908 | 6.484508 |
| −0.351038 | −0.028833 | 6.484508 |
| −0.327721 | −0.029126 | 6.484508 |
| −0.302193 | −0.029938 | 6.484508 |
| −0.275583 | −0.031399 | 6.484508 |
| −0.247906 | −0.033564 | 6.484508 |
| −0.219183 | −0.036488 | 6.484508 |
| −0.189436 | −0.040236 | 6.484508 |

TABLE I-continued

| X/CHX | Y/CHX | Z/CHX |
|---|---|---|
| −0.158691 | −0.044869 | 6.484508 |
| −0.126975 | −0.050448 | 6.484508 |
| −0.094318 | −0.057033 | 6.484508 |
| −0.061838 | −0.064435 | 6.484508 |
| −0.029557 | −0.072662 | 6.484508 |
| 0.002500 | −0.081725 | 6.484508 |
| 0.034303 | −0.091646 | 6.484508 |
| 0.065811 | −0.102462 | 6.484508 |
| 0.096988 | −0.114202 | 6.484508 |
| 0.127778 | −0.126916 | 6.484508 |
| 0.158131 | −0.140636 | 6.484508 |
| 0.187998 | −0.155394 | 6.484508 |
| 0.217312 | −0.171218 | 6.484508 |
| 0.246012 | −0.188127 | 6.484508 |
| 0.273122 | −0.205509 | 6.484508 |
| 0.298647 | −0.223257 | 6.484508 |
| 0.322622 | −0.241262 | 6.484508 |
| 0.345077 | −0.259405 | 6.484508 |
| 0.366059 | −0.277583 | 6.484508 |
| 0.385623 | −0.295680 | 6.484508 |
| 0.403823 | −0.313598 | 6.484508 |
| 0.419965 | −0.330425 | 6.484508 |
| 0.434174 | −0.346026 | 6.484508 |
| 0.446564 | −0.360266 | 6.484508 |
| 0.457243 | −0.373049 | 6.484508 |
| 0.466300 | −0.384279 | 6.484508 |
| 0.473823 | −0.393892 | 6.484508 |
| 0.480150 | −0.402187 | 6.484508 |
| 0.485395 | −0.409217 | 6.484508 |
| 0.489662 | −0.415040 | 6.484508 |
| 0.493435 | −0.419374 | 6.484508 |
| 0.497183 | −0.421642 | 6.484508 |
| 0.500462 | −0.422172 | 6.484508 |
| 0.503201 | −0.421866 | 6.484508 |
| 0.505266 | −0.421144 | 6.484508 |
| −0.467580 | 0.002293 | 6.895319 |
| −0.469157 | 0.003641 | 6.895319 |
| −0.470920 | 0.005770 | 6.895319 |
| −0.472564 | 0.008806 | 6.895319 |
| −0.473811 | 0.012748 | 6.895319 |
| −0.474456 | 0.018225 | 6.895319 |
| −0.473919 | 0.025389 | 6.895319 |
| −0.471771 | 0.034100 | 6.895319 |
| −0.467670 | 0.044204 | 6.895319 |
| −0.461350 | 0.055542 | 6.895319 |
| −0.452555 | 0.067941 | 6.895319 |
| −0.440882 | 0.081601 | 6.895319 |
| −0.426254 | 0.096295 | 6.895319 |
| −0.408640 | 0.111853 | 6.895319 |
| −0.387992 | 0.128089 | 6.895319 |
| −0.364188 | 0.144702 | 6.895319 |
| −0.336943 | 0.161094 | 6.895319 |
| −0.307292 | 0.175984 | 6.895319 |
| −0.275228 | 0.188873 | 6.895319 |
| −0.240823 | 0.199231 | 6.895319 |
| −0.204235 | 0.206517 | 6.895319 |
| −0.165711 | 0.210184 | 6.895319 |
| −0.125632 | 0.209723 | 6.895319 |
| −0.084477 | 0.204712 | 6.895319 |
| −0.044116 | 0.195279 | 6.895319 |
| −0.004946 | 0.181715 | 6.895319 |
| 0.032747 | 0.164443 | 6.895319 |
| 0.068793 | 0.143914 | 6.895319 |
| 0.103132 | 0.120680 | 6.895319 |
| 0.135773 | 0.095094 | 6.895319 |
| 0.166845 | 0.067634 | 6.895319 |
| 0.196456 | 0.038603 | 6.895319 |
| 0.224730 | 0.008252 | 6.895319 |
| 0.251794 | −0.023182 | 6.895319 |
| 0.277745 | −0.055532 | 6.895319 |
| 0.301835 | −0.087586 | 6.895319 |
| 0.324250 | −0.119146 | 6.895319 |
| 0.345119 | −0.150100 | 6.895319 |
| 0.364580 | −0.180323 | 6.895319 |
| 0.382733 | −0.209737 | 6.895319 |
| 0.399682 | −0.238265 | 6.895319 |
| 0.415505 | −0.265848 | 6.895319 |

TABLE I-continued

| X/CHX | Y/CHX | Z/CHX |
|---|---|---|
| 0.429621 | −0.291220 | 6.895319 |
| 0.442131 | −0.314323 | 6.895319 |
| 0.453128 | −0.335096 | 6.895319 |
| 0.462674 | −0.353505 | 6.895319 |
| 0.470833 | −0.369514 | 6.895319 |
| 0.477655 | −0.383097 | 6.895319 |
| 0.483423 | −0.394732 | 6.895319 |
| 0.488227 | −0.404532 | 6.895319 |
| 0.492150 | −0.412610 | 6.895319 |
| 0.495269 | −0.419081 | 6.895319 |
| 0.496697 | −0.424388 | 6.895319 |
| 0.496130 | −0.428534 | 6.895319 |
| 0.494700 | −0.431547 | 6.895319 |
| 0.492944 | −0.433611 | 6.895319 |
| 0.491269 | −0.434964 | 6.895319 |
| −0.466191 | 0.001401 | 6.895319 |
| −0.464199 | 0.000467 | 6.895319 |
| −0.461579 | −0.000360 | 6.895319 |
| −0.458345 | −0.001006 | 6.895319 |
| −0.453973 | −0.001493 | 6.895319 |
| −0.448257 | −0.001747 | 6.895319 |
| −0.441105 | −0.001763 | 6.895319 |
| −0.432419 | −0.001455 | 6.895319 |
| −0.422089 | −0.000900 | 6.895319 |
| −0.409997 | −0.000342 | 6.895319 |
| −0.395700 | 0.000150 | 6.895319 |
| −0.379196 | 0.000444 | 6.895319 |
| −0.360489 | 0.000405 | 6.895319 |
| −0.339588 | −0.000107 | 6.895319 |
| −0.316507 | −0.001242 | 6.895319 |
| −0.291271 | −0.003161 | 6.895319 |
| −0.265003 | −0.005902 | 6.895319 |
| −0.237732 | −0.009518 | 6.895319 |
| −0.209485 | −0.014061 | 6.895319 |
| −0.180293 | −0.019587 | 6.895319 |
| −0.150188 | −0.026145 | 6.895319 |
| −0.119205 | −0.033789 | 6.895319 |
| −0.087382 | −0.042572 | 6.895319 |
| −0.055811 | −0.052220 | 6.895319 |
| −0.024515 | −0.062723 | 6.895319 |
| 0.006483 | −0.074078 | 6.895319 |
| 0.037154 | −0.086292 | 6.895319 |
| 0.067462 | −0.099377 | 6.895319 |
| 0.097374 | −0.113345 | 6.895319 |
| 0.126845 | −0.128217 | 6.895319 |
| 0.155834 | −0.144004 | 6.895319 |
| 0.184303 | −0.160720 | 6.895319 |
| 0.212205 | −0.178364 | 6.895319 |
| 0.239495 | −0.196935 | 6.895319 |
| 0.265263 | −0.215761 | 6.895319 |
| 0.289535 | −0.234736 | 6.895319 |
| 0.312356 | −0.253763 | 6.895319 |
| 0.333772 | −0.272734 | 6.895319 |
| 0.353833 | −0.291557 | 6.895319 |
| 0.372601 | −0.310138 | 6.895319 |
| 0.390128 | −0.328396 | 6.895319 |
| 0.405743 | −0.345430 | 6.895319 |
| 0.419553 | −0.361133 | 6.895319 |
| 0.431655 | −0.375397 | 6.895319 |
| 0.442133 | −0.388149 | 6.895319 |
| 0.451063 | −0.399315 | 6.895319 |
| 0.458511 | −0.408846 | 6.895319 |
| 0.464798 | −0.417052 | 6.895319 |
| 0.470025 | −0.423992 | 6.895319 |
| 0.474289 | −0.429733 | 6.895319 |
| 0.478050 | −0.434006 | 6.895319 |
| 0.481771 | −0.436243 | 6.895319 |
| 0.485021 | −0.436768 | 6.895319 |
| 0.487737 | −0.436473 | 6.895319 |
| 0.489787 | −0.435767 | 6.895319 |
| −0.456009 | 0.028415 | 7.291442 |
| −0.457535 | 0.029762 | 7.291442 |
| −0.459242 | 0.031869 | 7.291442 |
| −0.460803 | 0.034874 | 7.291442 |
| −0.461907 | 0.038770 | 7.291442 |
| −0.462276 | 0.044168 | 7.291442 |
| −0.461348 | 0.051149 | 7.291442 |

TABLE I-continued

| X/CHX | Y/CHX | Z/CHX |
|---|---|---|
| −0.458745 | 0.059552 | 7.291442 |
| −0.454179 | 0.069224 | 7.291442 |
| −0.447434 | 0.080022 | 7.291442 |
| −0.438284 | 0.091794 | 7.291442 |
| −0.426322 | 0.104734 | 7.291442 |
| −0.411444 | 0.118595 | 7.291442 |
| −0.393591 | 0.133172 | 7.291442 |
| −0.372687 | 0.148222 | 7.291442 |
| −0.348574 | 0.163352 | 7.291442 |
| −0.320995 | 0.177902 | 7.291442 |
| −0.291047 | 0.190624 | 7.291442 |
| −0.258791 | 0.201013 | 7.291442 |
| −0.224372 | 0.208553 | 7.291442 |
| −0.188027 | 0.212731 | 7.291442 |
| −0.150079 | 0.213078 | 7.291442 |
| −0.110962 | 0.209205 | 7.291442 |
| −0.071172 | 0.200838 | 7.291442 |
| −0.032484 | 0.188349 | 7.291442 |
| 0.004792 | 0.172125 | 7.291442 |
| 0.040472 | 0.152620 | 7.291442 |
| 0.074477 | 0.130288 | 7.291442 |
| 0.106827 | 0.105647 | 7.291442 |
| 0.137582 | 0.079034 | 7.291442 |
| 0.166882 | 0.050828 | 7.291442 |
| 0.194847 | 0.021296 | 7.291442 |
| 0.221597 | −0.009349 | 7.291442 |
| 0.247250 | −0.040920 | 7.291442 |
| 0.271901 | −0.073272 | 7.291442 |
| 0.294834 | −0.105216 | 7.291442 |
| 0.316219 | −0.136584 | 7.291442 |
| 0.336177 | −0.167277 | 7.291442 |
| 0.354828 | −0.197193 | 7.291442 |
| 0.372263 | −0.226263 | 7.291442 |
| 0.388574 | −0.254422 | 7.291442 |
| 0.403834 | −0.281620 | 7.291442 |
| 0.417471 | −0.306616 | 7.291442 |
| 0.429577 | −0.329360 | 7.291442 |
| 0.440234 | −0.349800 | 7.291442 |
| 0.449497 | −0.367905 | 7.291442 |
| 0.457423 | −0.383643 | 7.291442 |
| 0.464057 | −0.396992 | 7.291442 |
| 0.469672 | −0.408425 | 7.291442 |
| 0.474352 | −0.418051 | 7.291442 |
| 0.478176 | −0.425984 | 7.291442 |
| 0.481217 | −0.432339 | 7.291442 |
| 0.482583 | −0.437551 | 7.291442 |
| 0.481991 | −0.441613 | 7.291442 |
| 0.480562 | −0.444552 | 7.291442 |
| 0.478822 | −0.446562 | 7.291442 |
| 0.477167 | −0.447876 | 7.291442 |
| −0.454647 | 0.027500 | 7.291442 |
| −0.452695 | 0.026516 | 7.291442 |
| −0.450117 | 0.025617 | 7.291442 |
| −0.446921 | 0.024895 | 7.291442 |
| −0.442583 | 0.024359 | 7.291442 |
| −0.436904 | 0.024112 | 7.291442 |
| −0.429798 | 0.024186 | 7.291442 |
| −0.421173 | 0.024630 | 7.291442 |
| −0.410919 | 0.025340 | 7.291442 |
| −0.398908 | 0.025988 | 7.291442 |
| −0.384700 | 0.026448 | 7.291442 |
| −0.368299 | 0.026558 | 7.291442 |
| −0.349715 | 0.026155 | 7.291442 |
| −0.328968 | 0.025076 | 7.291442 |
| −0.306087 | 0.023153 | 7.291442 |
| −0.281111 | 0.020212 | 7.291442 |
| −0.255163 | 0.016292 | 7.291442 |
| −0.228279 | 0.011345 | 7.291442 |
| −0.200494 | 0.005327 | 7.291442 |
| −0.171847 | −0.001806 | 7.291442 |
| −0.142375 | −0.010097 | 7.291442 |
| −0.112119 | −0.019589 | 7.291442 |
| −0.081123 | −0.030326 | 7.291442 |
| −0.050452 | −0.041958 | 7.291442 |
| −0.020126 | −0.054463 | 7.291442 |
| 0.009833 | −0.067822 | 7.291442 |
| 0.039403 | −0.082028 | 7.291442 |

TABLE I-continued

| X/CHX | Y/CHX | Z/CHX |
|---|---|---|
| 0.068552 | −0.097072 | 7.291442 |
| 0.097257 | −0.112950 | 7.291442 |
| 0.125483 | −0.129661 | 7.291442 |
| 0.153201 | −0.147201 | 7.291442 |
| 0.180383 | −0.165564 | 7.291442 |
| 0.207002 | −0.184735 | 7.291442 |
| 0.233031 | −0.204694 | 7.291442 |
| 0.257615 | −0.224725 | 7.291442 |
| 0.280796 | −0.244723 | 7.291442 |
| 0.302624 | −0.264602 | 7.291442 |
| 0.323154 | −0.284269 | 7.291442 |
| 0.342439 | −0.303642 | 7.291442 |
| 0.360540 | −0.322644 | 7.291442 |
| 0.377508 | −0.341206 | 7.291442 |
| 0.392687 | −0.358436 | 7.291442 |
| 0.406167 | −0.374248 | 7.291442 |
| 0.418031 | −0.388558 | 7.291442 |
| 0.428344 | −0.401310 | 7.291442 |
| 0.437169 | −0.412444 | 7.291442 |
| 0.444555 | −0.421926 | 7.291442 |
| 0.450807 | −0.430074 | 7.291442 |
| 0.456020 | −0.436954 | 7.291442 |
| 0.460280 | −0.442637 | 7.291442 |
| 0.464026 | −0.446874 | 7.291442 |
| 0.467720 | −0.449104 | 7.291442 |
| 0.470948 | −0.449635 | 7.291442 |
| 0.473649 | −0.449354 | 7.291442 |
| 0.475690 | −0.448664 | 7.291442 |
| −0.431225 | 0.082430 | 8.222230 |
| −0.432602 | 0.083820 | 8.222230 |
| −0.434116 | 0.085946 | 8.222230 |
| −0.435408 | 0.088933 | 8.222230 |
| −0.436112 | 0.092756 | 8.222230 |
| −0.435821 | 0.097949 | 8.222230 |
| −0.434000 | 0.104465 | 8.222230 |
| −0.430387 | 0.112111 | 8.222230 |
| −0.424802 | 0.120747 | 8.222230 |
| −0.417104 | 0.130268 | 8.222230 |
| −0.407132 | 0.140567 | 8.222230 |
| −0.394444 | 0.151797 | 8.222230 |
| −0.378904 | 0.163659 | 8.222230 |
| −0.360418 | 0.175878 | 8.222230 |
| −0.338880 | 0.188094 | 8.222230 |
| −0.314106 | 0.199715 | 8.222230 |
| −0.285943 | 0.209979 | 8.222230 |
| −0.255647 | 0.217759 | 8.222230 |
| −0.223426 | 0.222550 | 8.222230 |
| −0.189581 | 0.223903 | 8.222230 |
| −0.154498 | 0.221451 | 8.222230 |
| −0.118605 | 0.214930 | 8.222230 |
| −0.082359 | 0.204237 | 8.222230 |
| −0.046190 | 0.189400 | 8.222230 |
| −0.011577 | 0.171228 | 8.222230 |
| 0.021390 | 0.150222 | 8.222230 |
| 0.052719 | 0.126832 | 8.222230 |
| 0.082482 | 0.101457 | 8.222230 |
| 0.110812 | 0.074505 | 8.222230 |
| 0.137835 | 0.046243 | 8.222230 |
| 0.163678 | 0.016897 | 8.222230 |
| 0.188460 | −0.013353 | 8.222230 |
| 0.212282 | −0.044367 | 8.222230 |
| 0.235234 | −0.076032 | 8.222230 |
| 0.257405 | −0.108245 | 8.222230 |
| 0.278135 | −0.139859 | 8.222230 |
| 0.297562 | −0.170759 | 8.222230 |
| 0.315782 | −0.200873 | 8.222230 |
| 0.332888 | −0.230133 | 8.222230 |
| 0.348954 | −0.258486 | 8.222230 |
| 0.364047 | −0.285891 | 8.222230 |
| 0.378227 | −0.312309 | 8.222230 |
| 0.390945 | −0.336550 | 8.222230 |
| 0.402271 | −0.358580 | 8.222230 |
| 0.412267 | −0.378358 | 8.222230 |
| 0.420980 | −0.395862 | 8.222230 |
| 0.428453 | −0.411066 | 8.222230 |
| 0.434720 | −0.423955 | 8.222230 |
| 0.440034 | −0.434988 | 8.222230 |

TABLE I-continued

| X/CHX | Y/CHX | Z/CHX |
|---|---|---|
| 0.444470 | −0.444274 | 8.222230 |
| 0.448100 | −0.451923 | 8.222230 |
| 0.450990 | −0.458049 | 8.222230 |
| 0.452247 | −0.463071 | 8.222230 |
| 0.451612 | −0.466969 | 8.222230 |
| 0.450193 | −0.469764 | 8.222230 |
| 0.448486 | −0.471668 | 8.222230 |
| 0.446872 | −0.472907 | 8.222230 |
| −0.429951 | 0.081421 | 8.222230 |
| −0.428110 | 0.080281 | 8.222230 |
| −0.425643 | 0.079171 | 8.222230 |
| −0.422545 | 0.078211 | 8.222230 |
| −0.418286 | 0.077432 | 8.222230 |
| −0.412675 | 0.076997 | 8.222230 |
| −0.405639 | 0.076988 | 8.222230 |
| −0.397096 | 0.077408 | 8.222230 |
| −0.386938 | 0.078084 | 8.222230 |
| −0.375036 | 0.078578 | 8.222230 |
| −0.360958 | 0.078654 | 8.222230 |
| −0.344725 | 0.078083 | 8.222230 |
| −0.326371 | 0.076658 | 8.222230 |
| −0.305948 | 0.074175 | 8.222230 |
| −0.283517 | 0.070441 | 8.222230 |
| −0.259152 | 0.065277 | 8.222230 |
| −0.233973 | 0.058834 | 8.222230 |
| −0.208032 | 0.051090 | 8.222230 |
| −0.181376 | 0.042024 | 8.222230 |
| −0.154052 | 0.031620 | 8.222230 |
| −0.126108 | 0.019852 | 8.222230 |
| −0.097592 | 0.006694 | 8.222230 |
| −0.068556 | −0.007879 | 8.222230 |
| −0.039999 | −0.023368 | 8.222230 |
| −0.011930 | −0.039724 | 8.222230 |
| 0.015644 | −0.056903 | 8.222230 |
| 0.042714 | −0.074869 | 8.222230 |
| 0.069273 | −0.093579 | 8.222230 |
| 0.095317 | −0.113000 | 8.222230 |
| 0.120841 | −0.133098 | 8.222230 |
| 0.145846 | −0.153839 | 8.222230 |
| 0.170332 | −0.175191 | 8.222230 |
| 0.194304 | −0.197120 | 8.222230 |
| 0.217772 | −0.219584 | 8.222230 |
| 0.239987 | −0.241785 | 8.222230 |
| 0.261012 | −0.263634 | 8.222230 |
| 0.280903 | −0.285065 | 8.222230 |
| 0.299718 | −0.306013 | 8.222230 |
| 0.317510 | −0.326419 | 8.222230 |
| 0.334332 | −0.346233 | 8.222230 |
| 0.350230 | −0.365406 | 8.222230 |
| 0.364572 | −0.383056 | 8.222230 |
| 0.377413 | −0.399138 | 8.222230 |
| 0.388806 | −0.413600 | 8.222230 |
| 0.398784 | −0.426416 | 8.222230 |
| 0.407383 | −0.437552 | 8.222230 |
| 0.414625 | −0.446997 | 8.222230 |
| 0.420788 | −0.455086 | 8.222230 |
| 0.425949 | −0.461896 | 8.222230 |
| 0.430183 | −0.467508 | 8.222230 |
| 0.433872 | −0.471721 | 8.222230 |
| 0.437498 | −0.473988 | 8.222230 |
| 0.440687 | −0.474558 | 8.222230 |
| 0.443368 | −0.474318 | 8.222230 |
| 0.445399 | −0.473665 | 8.222230 |
| −0.406732 | 0.134464 | 9.280770 |
| −0.407841 | 0.135985 | 9.280770 |
| −0.408975 | 0.138225 | 9.280770 |
| −0.409751 | 0.141257 | 9.280770 |
| −0.409801 | 0.144993 | 9.280770 |
| −0.408677 | 0.149863 | 9.280770 |
| −0.405878 | 0.155737 | 9.280770 |
| −0.401243 | 0.162422 | 9.280770 |
| −0.394652 | 0.169801 | 9.280770 |
| −0.386003 | 0.177793 | 9.280770 |
| −0.375161 | 0.186309 | 9.280770 |
| −0.361648 | 0.195417 | 9.280770 |
| −0.345327 | 0.204750 | 9.280770 |
| −0.326109 | 0.213960 | 9.280770 |

TABLE I-continued

| X/CHX | Y/CHX | Z/CHX |
|---|---|---|
| −0.303903 | 0.222560 | 9.280770 |
| −0.278617 | 0.229824 | 9.280770 |
| −0.250255 | 0.234958 | 9.280770 |
| −0.220254 | 0.237097 | 9.280770 |
| −0.188953 | 0.235855 | 9.280770 |
| −0.156747 | 0.230955 | 9.280770 |
| −0.124060 | 0.222253 | 9.280770 |
| −0.091297 | 0.209715 | 9.280770 |
| −0.058796 | 0.193450 | 9.280770 |
| −0.026819 | 0.173669 | 9.280770 |
| 0.003491 | 0.151415 | 9.280770 |
| 0.032224 | 0.127162 | 9.280770 |
| 0.059503 | 0.101283 | 9.280770 |
| 0.085468 | 0.074071 | 9.280770 |
| 0.110289 | 0.045817 | 9.280770 |
| 0.134098 | 0.016709 | 9.280770 |
| 0.156996 | −0.013125 | 9.280770 |
| 0.179074 | −0.043571 | 9.280770 |
| 0.200414 | −0.074538 | 9.280770 |
| 0.221079 | −0.105963 | 9.280770 |
| 0.241142 | −0.137772 | 9.280770 |
| 0.260000 | −0.168855 | 9.280770 |
| 0.277753 | −0.199137 | 9.280770 |
| 0.294478 | −0.228564 | 9.280770 |
| 0.310243 | −0.257093 | 9.280770 |
| 0.325108 | −0.284684 | 9.280770 |
| 0.339123 | −0.311309 | 9.280770 |
| 0.352334 | −0.336938 | 9.280770 |
| 0.364218 | −0.360431 | 9.280770 |
| 0.374830 | −0.381757 | 9.280770 |
| 0.384218 | −0.400890 | 9.280770 |
| 0.392418 | −0.417811 | 9.280770 |
| 0.399463 | −0.432502 | 9.280770 |
| 0.405381 | −0.444950 | 9.280770 |
| 0.410405 | −0.455602 | 9.280770 |
| 0.414604 | −0.464565 | 9.280770 |
| 0.418042 | −0.471946 | 9.280770 |
| 0.420783 | −0.477855 | 9.280770 |
| 0.421939 | −0.482694 | 9.280770 |
| 0.421276 | −0.486437 | 9.280770 |
| 0.419871 | −0.489098 | 9.280770 |
| 0.418199 | −0.490900 | 9.280770 |
| 0.416623 | −0.492066 | 9.280770 |
| −0.405637 | 0.133281 | 9.280770 |
| −0.404008 | 0.131880 | 9.280770 |
| −0.401752 | 0.130426 | 9.280770 |
| −0.398837 | 0.129065 | 9.280770 |
| −0.394740 | 0.127783 | 9.280770 |
| −0.389246 | 0.126791 | 9.280770 |
| −0.382294 | 0.126185 | 9.280770 |
| −0.373812 | 0.125945 | 9.280770 |
| −0.363713 | 0.125830 | 9.280770 |
| −0.351902 | 0.125422 | 9.280770 |
| −0.337973 | 0.124408 | 9.280770 |
| −0.321970 | 0.122512 | 9.280770 |
| −0.303958 | 0.119501 | 9.280770 |
| −0.284012 | 0.115171 | 9.280770 |
| −0.262222 | 0.109336 | 9.280770 |
| −0.238685 | 0.101821 | 9.280770 |
| −0.214501 | 0.092882 | 9.280770 |
| −0.189724 | 0.082517 | 9.280770 |
| −0.164407 | 0.070717 | 9.280770 |
| −0.138600 | 0.057476 | 9.280770 |
| −0.112354 | 0.042781 | 9.280770 |
| −0.085721 | 0.026614 | 9.280770 |
| −0.058754 | 0.008964 | 9.280770 |
| −0.032375 | −0.009554 | 9.280770 |
| −0.006579 | −0.028873 | 9.280770 |
| 0.018640 | −0.048942 | 9.280770 |
| 0.043293 | −0.069705 | 9.280770 |
| 0.067395 | −0.091103 | 9.280770 |
| 0.090962 | −0.113087 | 9.280770 |
| 0.114015 | −0.135611 | 9.280770 |
| 0.136576 | −0.158629 | 9.280770 |
| 0.158668 | −0.182096 | 9.280770 |
| 0.180317 | −0.205974 | 9.280770 |
| 0.201556 | −0.230216 | 9.280770 |

TABLE I-continued

| X/CHX | Y/CHX | Z/CHX |
|---|---|---|
| 0.221722 | −0.253966 | 9.280770 |
| 0.240885 | −0.277155 | 9.280770 |
| 0.259100 | −0.299730 | 9.280770 |
| 0.276423 | −0.321644 | 9.280770 |
| 0.292902 | −0.342853 | 9.280770 |
| 0.308579 | −0.363325 | 9.280770 |
| 0.323492 | −0.383028 | 9.280770 |
| 0.337032 | −0.401075 | 9.280770 |
| 0.349230 | −0.417447 | 9.280770 |
| 0.360118 | −0.432111 | 9.280770 |
| 0.369705 | −0.445061 | 9.280770 |
| 0.378010 | −0.456279 | 9.280770 |
| 0.385033 | −0.465768 | 9.280770 |
| 0.391031 | −0.473876 | 9.280770 |
| 0.396070 | −0.480691 | 9.280770 |
| 0.400215 | −0.486297 | 9.280770 |
| 0.403786 | −0.490552 | 9.280770 |
| 0.407311 | −0.492920 | 9.280770 |
| 0.410457 | −0.493574 | 9.280770 |
| 0.413123 | −0.493399 | 9.280770 |
| 0.415150 | −0.492792 | 9.280770 |
| −0.382600 | 0.183894 | 10.490160 |
| −0.383249 | 0.185582 | 10.490160 |
| −0.383746 | 0.187944 | 10.490160 |
| −0.383731 | 0.190953 | 10.490160 |
| −0.382915 | 0.194456 | 10.490160 |
| −0.380860 | 0.198797 | 10.490160 |
| −0.377106 | 0.203807 | 10.490160 |
| −0.371543 | 0.209308 | 10.490160 |
| −0.364064 | 0.215189 | 10.490160 |
| −0.354569 | 0.221360 | 10.490160 |
| −0.342935 | 0.227707 | 10.490160 |
| −0.328663 | 0.234170 | 10.490160 |
| −0.311663 | 0.240314 | 10.490160 |
| −0.291895 | 0.245699 | 10.490160 |
| −0.269362 | 0.249742 | 10.490160 |
| −0.244144 | 0.251712 | 10.490160 |
| −0.216453 | 0.250915 | 10.490160 |
| −0.187816 | 0.246922 | 10.490160 |
| −0.158606 | 0.239581 | 10.490160 |
| −0.129180 | 0.228843 | 10.490160 |
| −0.099854 | 0.214770 | 10.490160 |
| −0.070880 | 0.197497 | 10.490160 |
| −0.042434 | 0.177203 | 10.490160 |
| −0.014604 | 0.154125 | 10.490160 |
| 0.011740 | 0.129362 | 10.490160 |
| 0.036767 | 0.103270 | 10.490160 |
| 0.060637 | 0.076116 | 10.490160 |
| 0.083476 | 0.048082 | 10.490160 |
| 0.105436 | 0.019357 | 10.490160 |
| 0.126630 | −0.009936 | 10.490160 |
| 0.147129 | −0.039721 | 10.490160 |
| 0.167000 | −0.069930 | 10.490160 |
| 0.186302 | −0.100504 | 10.490160 |
| 0.205081 | −0.131404 | 10.490160 |
| 0.223390 | −0.162583 | 10.490160 |
| 0.240672 | −0.192965 | 10.490160 |
| 0.257005 | −0.222498 | 10.490160 |
| 0.272447 | −0.251143 | 10.490160 |
| 0.287048 | −0.278871 | 10.490160 |
| 0.300857 | −0.305652 | 10.490160 |
| 0.313910 | −0.331467 | 10.490160 |
| 0.326244 | −0.356293 | 10.490160 |
| 0.337363 | −0.379031 | 10.490160 |
| 0.347311 | −0.399660 | 10.490160 |
| 0.356126 | −0.418157 | 10.490160 |
| 0.363836 | −0.434508 | 10.490160 |
| 0.370470 | −0.448698 | 10.490160 |
| 0.376047 | −0.460719 | 10.490160 |
| 0.380787 | −0.471003 | 10.490160 |
| 0.384752 | −0.479653 | 10.490160 |
| 0.388001 | −0.486776 | 10.490160 |
| 0.390592 | −0.492477 | 10.490160 |
| 0.391657 | −0.497142 | 10.490160 |
| 0.390975 | −0.500732 | 10.490160 |
| 0.389590 | −0.503264 | 10.490160 |
| 0.387953 | −0.504970 | 10.490160 |

TABLE I-continued

| X/CHX | Y/CHX | Z/CHX |
|---|---|---|
| 0.386416 | −0.506067 | 10.490160 |
| −0.381865 | 0.182473 | 10.490160 |
| −0.380655 | 0.180719 | 10.490160 |
| −0.378832 | 0.178778 | 10.490160 |
| −0.376317 | 0.176815 | 10.490160 |
| −0.372612 | 0.174722 | 10.490160 |
| −0.367449 | 0.172719 | 10.490160 |
| −0.360767 | 0.170915 | 10.490160 |
| −0.352510 | 0.169283 | 10.490160 |
| −0.342632 | 0.167607 | 10.490160 |
| −0.331087 | 0.165572 | 10.490160 |
| −0.317508 | 0.162821 | 10.490160 |
| −0.301979 | 0.159029 | 10.490160 |
| −0.284582 | 0.153973 | 10.490160 |
| −0.265404 | 0.147480 | 10.490160 |
| −0.244540 | 0.139387 | 10.490160 |
| −0.222098 | 0.129535 | 10.490160 |
| −0.199130 | 0.118281 | 10.490160 |
| −0.175694 | 0.105609 | 10.490160 |
| −0.151842 | 0.091508 | 10.490160 |
| −0.127626 | 0.075968 | 10.490160 |
| −0.103100 | 0.058975 | 10.490160 |
| −0.078315 | 0.040512 | 10.490160 |
| −0.053322 | 0.020573 | 10.490160 |
| −0.028972 | −0.000145 | 10.490160 |
| −0.005243 | −0.021572 | 10.490160 |
| 0.017882 | −0.043648 | 10.490160 |
| 0.040428 | −0.066320 | 10.490160 |
| 0.062422 | −0.089525 | 10.490160 |
| 0.083901 | −0.113206 | 10.490160 |
| 0.104889 | −0.137325 | 10.490160 |
| 0.125425 | −0.161830 | 10.490160 |
| 0.145547 | −0.186676 | 10.490160 |
| 0.165290 | −0.211825 | 10.490160 |
| 0.184700 | −0.237231 | 10.490160 |
| 0.203173 | −0.262009 | 10.490160 |
| 0.220782 | −0.286101 | 10.490160 |
| 0.237579 | −0.309465 | 10.490160 |
| 0.253612 | −0.332066 | 10.490160 |
| 0.268925 | −0.353869 | 10.490160 |
| 0.283551 | −0.374853 | 10.490160 |
| 0.297524 | −0.394993 | 10.490160 |
| 0.310261 | −0.413396 | 10.490160 |
| 0.321778 | −0.430056 | 10.490160 |
| 0.332094 | −0.444950 | 10.490160 |
| 0.341207 | −0.458081 | 10.490160 |
| 0.349125 | −0.469438 | 10.490160 |
| 0.355838 | −0.479033 | 10.490160 |
| 0.361583 | −0.487222 | 10.490160 |
| 0.366418 | −0.494098 | 10.490160 |
| 0.370401 | −0.499750 | 10.490160 |
| 0.373792 | −0.504097 | 10.490160 |
| 0.377177 | −0.506616 | 10.490160 |
| 0.380266 | −0.507391 | 10.490160 |
| 0.382916 | −0.507303 | 10.490160 |
| 0.384940 | −0.506756 | 10.490160 |
| −0.358846 | 0.228088 | 11.869830 |
| −0.358810 | 0.229828 | 11.869830 |
| −0.358430 | 0.232116 | 11.869830 |
| −0.357473 | 0.234850 | 11.869830 |
| −0.355778 | 0.237876 | 11.869830 |
| −0.352855 | 0.241465 | 11.869830 |
| −0.348328 | 0.245441 | 11.869830 |
| −0.342056 | 0.249608 | 11.869830 |
| −0.333923 | 0.253810 | 11.869830 |
| −0.323828 | 0.257908 | 11.869830 |
| −0.311664 | 0.261731 | 11.869830 |
| −0.296963 | 0.265061 | 11.869830 |
| −0.279733 | 0.267437 | 11.869830 |
| −0.260044 | 0.268323 | 11.869830 |
| −0.238054 | 0.267129 | 11.869830 |
| −0.214025 | 0.263279 | 11.869830 |
| −0.188300 | 0.256295 | 11.869830 |
| −0.162337 | 0.246301 | 11.869830 |
| −0.136389 | 0.233393 | 11.869830 |
| −0.110641 | 0.217719 | 11.869830 |
| −0.085209 | 0.199467 | 11.869830 |

TABLE I-continued

| X/CHX | Y/CHX | Z/CHX |
|---|---|---|
| −0.060159 | 0.178821 | 11.869830 |
| −0.035522 | 0.155937 | 11.869830 |
| −0.011284 | 0.130983 | 11.869830 |
| 0.011847 | 0.104998 | 11.869830 |
| 0.034019 | 0.078192 | 11.869830 |
| 0.055346 | 0.050709 | 11.869830 |
| 0.075901 | 0.022640 | 11.869830 |
| 0.095776 | −0.005913 | 11.869830 |
| 0.115048 | −0.034876 | 11.869830 |
| 0.133762 | −0.064202 | 11.869830 |
| 0.151970 | −0.093847 | 11.869830 |
| 0.169719 | −0.123768 | 11.869830 |
| 0.187039 | −0.153940 | 11.869830 |
| 0.203974 | −0.184329 | 11.869830 |
| 0.220003 | −0.213893 | 11.869830 |
| 0.235188 | −0.242594 | 11.869830 |
| 0.249576 | −0.270403 | 11.869830 |
| 0.263204 | −0.297299 | 11.869830 |
| 0.276110 | −0.323259 | 11.869830 |
| 0.288327 | −0.348266 | 11.869830 |
| 0.299887 | −0.372303 | 11.869830 |
| 0.310321 | −0.394307 | 11.869830 |
| 0.319664 | −0.414263 | 11.869830 |
| 0.327950 | −0.432152 | 11.869830 |
| 0.335202 | −0.447962 | 11.869830 |
| 0.341445 | −0.461679 | 11.869830 |
| 0.346697 | −0.473298 | 11.869830 |
| 0.351162 | −0.483236 | 11.869830 |
| 0.354899 | −0.491595 | 11.869830 |
| 0.357962 | −0.498477 | 11.869830 |
| 0.360405 | −0.503985 | 11.869830 |
| 0.361384 | −0.508489 | 11.869830 |
| 0.360693 | −0.511931 | 11.869830 |
| 0.359330 | −0.514343 | 11.869830 |
| 0.357729 | −0.515958 | 11.869830 |
| 0.356230 | −0.516990 | 11.869830 |
| −0.358701 | 0.226508 | 11.869830 |
| −0.358235 | 0.224445 | 11.869830 |
| −0.357241 | 0.221998 | 11.869830 |
| −0.355573 | 0.219311 | 11.869830 |
| −0.352770 | 0.216156 | 11.869830 |
| −0.348498 | 0.212703 | 11.869830 |
| −0.342667 | 0.209081 | 11.869830 |
| −0.335211 | 0.205330 | 11.869830 |
| −0.326088 | 0.201392 | 11.869830 |
| −0.315267 | 0.197132 | 11.869830 |
| −0.302447 | 0.192174 | 11.869830 |
| −0.287783 | 0.186134 | 11.869830 |
| −0.271375 | 0.178799 | 11.869830 |
| −0.253293 | 0.170051 | 11.869830 |
| −0.233625 | 0.159753 | 11.869830 |
| −0.212470 | 0.147765 | 11.869830 |
| −0.190827 | 0.134520 | 11.869830 |
| −0.168759 | 0.119975 | 11.869830 |
| −0.146325 | 0.104092 | 11.869830 |
| −0.123584 | 0.086840 | 11.869830 |
| −0.100595 | 0.068191 | 11.869830 |
| −0.077410 | 0.048130 | 11.869830 |
| −0.054076 | 0.026648 | 11.869830 |
| −0.031383 | 0.004489 | 11.869830 |
| −0.009306 | −0.018283 | 11.869830 |
| 0.012185 | −0.041608 | 11.869830 |
| 0.033118 | −0.065438 | 11.869830 |
| 0.053529 | −0.089715 | 11.869830 |
| 0.073455 | −0.114391 | 11.869830 |
| 0.092924 | −0.139430 | 11.869830 |
| 0.111978 | −0.164787 | 11.869830 |
| 0.130659 | −0.190419 | 11.869830 |
| 0.149002 | −0.216295 | 11.869830 |
| 0.167050 | −0.242377 | 11.869830 |
| 0.184241 | −0.267765 | 11.869830 |
| 0.200644 | −0.292409 | 11.869830 |
| 0.216305 | −0.316275 | 11.869830 |
| 0.231272 | −0.339332 | 11.869830 |
| 0.245585 | −0.361553 | 11.869830 |
| 0.259268 | −0.382922 | 11.869830 |
| 0.272345 | −0.403424 | 11.869830 |

TABLE I-continued

| X/CHX | Y/CHX | Z/CHX |
|---|---|---|
| 0.284274 | −0.422149 | 11.869830 |
| 0.295071 | −0.439094 | 11.869830 |
| 0.304750 | −0.454239 | 11.869830 |
| 0.313306 | −0.467588 | 11.869830 |
| 0.320744 | −0.479134 | 11.869830 |
| 0.327054 | −0.488887 | 11.869830 |
| 0.332456 | −0.497212 | 11.869830 |
| 0.337004 | −0.504201 | 11.869830 |
| 0.340752 | −0.509946 | 11.869830 |
| 0.343890 | −0.514430 | 11.869830 |
| 0.347083 | −0.517147 | 11.869830 |
| 0.350098 | −0.518089 | 11.869830 |
| 0.352729 | −0.518117 | 11.869830 |
| 0.354751 | −0.517639 | 11.869830 |
| −0.342285 | 0.254022 | 12.941541 |
| −0.341777 | 0.255645 | 12.941541 |
| −0.340851 | 0.257713 | 12.941541 |
| −0.339339 | 0.260105 | 12.941541 |
| −0.337144 | 0.262694 | 12.941541 |
| −0.333747 | 0.265692 | 12.941541 |
| −0.328834 | 0.268938 | 12.941541 |
| −0.322229 | 0.272181 | 12.941541 |
| −0.313814 | 0.275210 | 12.941541 |
| −0.303500 | 0.277840 | 12.941541 |
| −0.291201 | 0.279865 | 12.941541 |
| −0.276514 | 0.280963 | 12.941541 |
| −0.259519 | 0.280692 | 12.941541 |
| −0.240390 | 0.278501 | 12.941541 |
| −0.219391 | 0.273815 | 12.941541 |
| −0.196863 | 0.266197 | 12.941541 |
| −0.173199 | 0.255300 | 12.941541 |
| −0.149711 | 0.241609 | 12.941541 |
| −0.126524 | 0.225345 | 12.941541 |
| −0.103672 | 0.206755 | 12.941541 |
| −0.081118 | 0.186087 | 12.941541 |
| −0.058787 | 0.163550 | 12.941541 |
| −0.036615 | 0.139295 | 12.941541 |
| −0.014548 | 0.113435 | 12.941541 |
| 0.006765 | 0.086949 | 12.941541 |
| 0.027417 | 0.059946 | 12.941541 |
| 0.047454 | 0.032484 | 12.941541 |
| 0.066885 | 0.004587 | 12.941541 |
| 0.085741 | −0.023700 | 12.941541 |
| 0.104067 | −0.052333 | 12.941541 |
| 0.121898 | −0.081277 | 12.941541 |
| 0.139276 | −0.110496 | 12.941541 |
| 0.156239 | −0.139957 | 12.941541 |
| 0.172813 | −0.169640 | 12.941541 |
| 0.189033 | −0.199517 | 12.941541 |
| 0.204400 | −0.228566 | 12.941541 |
| 0.218968 | −0.256754 | 12.941541 |
| 0.232780 | −0.284056 | 12.941541 |
| 0.245870 | −0.310452 | 12.941541 |
| 0.258270 | −0.335924 | 12.941541 |
| 0.270010 | −0.360457 | 12.941541 |
| 0.281119 | −0.384035 | 12.941541 |
| 0.291147 | −0.405616 | 12.941541 |
| 0.300130 | −0.425186 | 12.941541 |
| 0.308097 | −0.442726 | 12.941541 |
| 0.315071 | −0.458226 | 12.941541 |
| 0.321075 | −0.471675 | 12.941541 |
| 0.326126 | −0.483065 | 12.941541 |
| 0.330420 | −0.492808 | 12.941541 |
| 0.334013 | −0.501002 | 12.941541 |
| 0.336959 | −0.507748 | 12.941541 |
| 0.339309 | −0.513148 | 12.941541 |
| 0.340253 | −0.517553 | 12.941541 |
| 0.339569 | −0.520914 | 12.941541 |
| 0.338225 | −0.523261 | 12.941541 |
| 0.336648 | −0.524825 | 12.941541 |
| 0.335172 | −0.525819 | 12.941541 |
| −0.342569 | 0.252466 | 12.941541 |
| −0.342701 | 0.250362 | 12.941541 |
| −0.342459 | 0.247743 | 12.941541 |
| −0.341642 | 0.244699 | 12.941541 |
| −0.339811 | 0.240907 | 12.941541 |
| −0.336623 | 0.236466 | 12.941541 |

TABLE I-continued

| X/CHX | Y/CHX | Z/CHX |
|---|---|---|
| −0.331900 | 0.231524 | 12.941541 |
| −0.325537 | 0.226171 | 12.941541 |
| −0.317451 | 0.220459 | 12.941541 |
| −0.307563 | 0.214423 | 12.941541 |
| −0.295610 | 0.207738 | 12.941541 |
| −0.281799 | 0.200058 | 12.941541 |
| −0.266300 | 0.191085 | 12.941541 |
| −0.249153 | 0.180759 | 12.941541 |
| −0.230434 | 0.168968 | 12.941541 |
| −0.210238 | 0.155582 | 12.941541 |
| −0.189529 | 0.141077 | 12.941541 |
| −0.168378 | 0.125385 | 12.941541 |
| −0.146855 | 0.108446 | 12.941541 |
| −0.125030 | 0.090208 | 12.941541 |
| −0.102962 | 0.070636 | 12.941541 |
| −0.080713 | 0.049700 | 12.941541 |
| −0.058327 | 0.027392 | 12.941541 |
| −0.036559 | 0.004480 | 12.941541 |
| −0.015388 | −0.018983 | 12.941541 |
| 0.005224 | −0.042940 | 12.941541 |
| 0.025309 | −0.067343 | 12.941541 |
| 0.044904 | −0.092139 | 12.941541 |
| 0.064043 | −0.117288 | 12.941541 |
| 0.082747 | −0.142762 | 12.941541 |
| 0.101058 | −0.168522 | 12.941541 |
| 0.119019 | −0.194527 | 12.941541 |
| 0.136658 | −0.220751 | 12.941541 |
| 0.154011 | −0.247165 | 12.941541 |
| 0.170535 | −0.272862 | 12.941541 |
| 0.186292 | −0.297798 | 12.941541 |
| 0.201327 | −0.321944 | 12.941541 |
| 0.215684 | −0.345270 | 12.941541 |
| 0.229400 | −0.367754 | 12.941541 |
| 0.242498 | −0.389380 | 12.941541 |
| 0.255000 | −0.410136 | 12.941541 |
| 0.266391 | −0.429101 | 12.941541 |
| 0.276688 | −0.446270 | 12.941541 |
| 0.285909 | −0.461624 | 12.941541 |
| 0.294052 | −0.475163 | 12.941541 |
| 0.301125 | −0.486879 | 12.941541 |
| 0.307121 | −0.496781 | 12.941541 |
| 0.312252 | −0.505235 | 12.941541 |
| 0.316569 | −0.512334 | 12.941541 |
| 0.320125 | −0.518171 | 12.941541 |
| 0.323056 | −0.522776 | 12.941541 |
| 0.326090 | −0.525657 | 12.941541 |
| 0.329043 | −0.526740 | 12.941541 |
| 0.331660 | −0.526863 | 12.941541 |
| 0.333687 | −0.526440 | 12.941541 |

Furthermore, the aerodynamic profile of the blade according to the invention is obtained with the values of Table I by stacking together the series of closed curves 20 and connecting them so as to obtain a continuous aerodynamic profile.

To take into account the dimensional variability of each blade 1, preferably obtained by means of a melting process, the profile of each blade 1 can have a tolerance of +/−0.3 mm in a normal direction with the profile of the blade 1 itself.

The profile of each blade 1 can also comprise a coating, subsequently applied and such as to vary the profile itself.

Figure 6A:
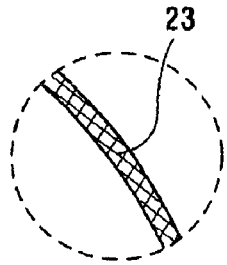
FIG. 6A is an enlarged detail taken from FIG. 6.
Figure 6:
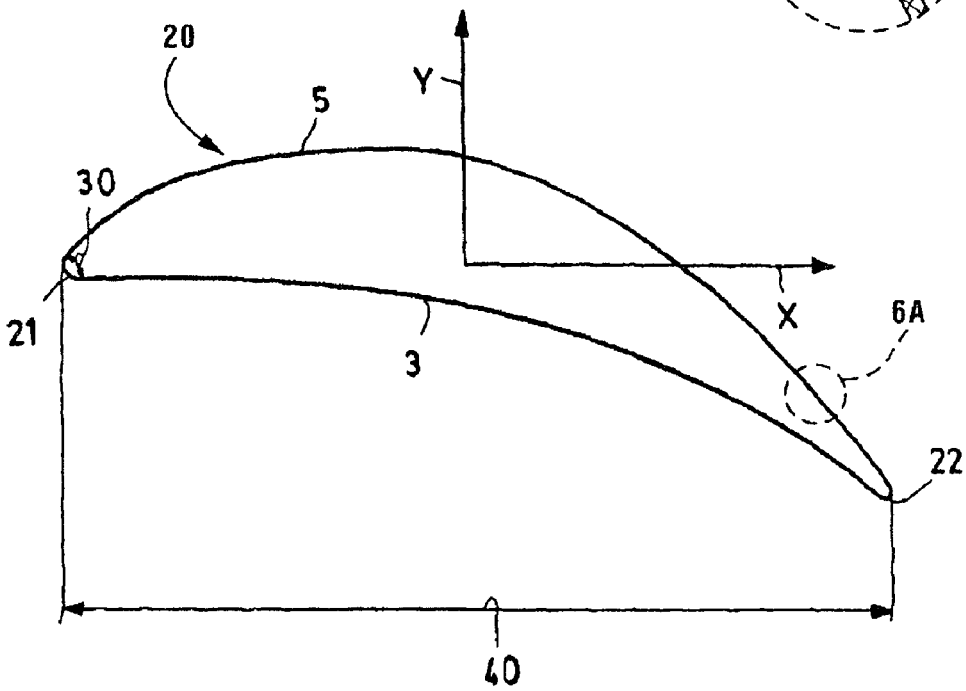
FIG. 6 is a sectional view of a blade according to the invention.

Preferably, said anti-wear coating 23 (see FIG. 6A) has a thickness defined in a normal direction with each surface of the blade and ranging from 0 to 0.5 mm.

Furthermore, it is evident that the values of the coordinates of Table I can be multiplied or divided by a corrective constant to obtain a profile in a greater or smaller scale, maintaining the same form.

It can thus be seen that a rotor blade for a first phase of a gas turbine according to the present invention achieves the objectives indicated above.

What is claimed is:

1. A blade of a rotor for a first phase of a gas turbine having a profile identified by means of a series of closed intersection curves between the profile itself and planes X, Y lying at distances Z from the central axis of the gas turbine, each closed curve having a first rounded end and a second rounded end which connect a trace of a first surface with a trace of a second surface in depression, said first end first meets a gas flow of the turbine, each closed curve having an axial chord defined as a maximum distance of the first end from the second end along a reference axis X, each closed curve having a dimensionless thickness of said first end defined as a maximum diameter of a circle inscribed in the first end, wherein said dimensionless thickness divided by said axial chord, has a quadric distribution according to a curve of the fourth order along an axis defining the distance (Z).

2. The blade according to claim 1, wherein said closed curves are defined according to Table I, wherein values set forth in Table I refer to a room temperature profiles, and for each closed curve, are divided by another value, CHX, expressed in millimetres, of the respective axial chord.

3. The blade according to claim 1 wherein the profile of each blade has a tolerance of +/−0.3 mm in a normal direction with the profile of the blade itself.

4. The blade according to claim 1, wherein the profile of each blade comprises an anti-wear coating.

5. The blade according to claim 4, wherein said coating has a thickness ranging from 0 to 0.5 mm.

* * * * *